US012690675B2

(12) United States Patent
Perez et al.

(10) Patent No.: US 12,690,675 B2
(45) Date of Patent: Jul. 28, 2026

(54) WINE CELLAR DRAWER, WINE CABINET AND KITCHEN CABINET

(71) Applicant: Dometic Sweden AB, Solna (SE)

(72) Inventors: Christophe Perez, Hässelby (SE); Samuele Meda, Chichester (GB); Anton Lundqvist, Älvsjö (SE)

(73) Assignee: Dometic Sweden AB, Solna (SE)

( * ) Notice: Subject to any disclaimer, the term of this patent is extended or adjusted under 35 U.S.C. 154(b) by 135 days.

(21) Appl. No.: 18/548,002

(22) PCT Filed: Dec. 21, 2021

(86) PCT No.: PCT/EP2021/087076
§ 371 (c)(1),
(2) Date: Aug. 25, 2023

(87) PCT Pub. No.: WO2022/179741
PCT Pub. Date: Sep. 1, 2022

(65) Prior Publication Data

US 2024/0292949 A1 Sep. 5, 2024

(30) Foreign Application Priority Data

Feb. 26, 2021 (EP) ..... 21159510

(51) Int. Cl.
*F25B 1/00* (2006.01)
*A47B 73/00* (2006.01)
(Continued)

(52) U.S. Cl.
CPC ..... *A47B 77/08* (2013.01); *A47B 73/00* (2013.01); *A47B 77/16* (2013.01); *F25B 1/00* (2013.01); *F25D 25/025* (2013.01)

(58) Field of Classification Search
CPC ..... A47B 73/00; A47B 77/08; A47B 77/16; F25D 25/025; F25D 29/00; F25D 31/007
See application file for complete search history.

(56) References Cited

U.S. PATENT DOCUMENTS

D662,525 S 6/2012 Moseley
9,982,937 B2 5/2018 Tierney et al.
(Continued)

FOREIGN PATENT DOCUMENTS

CN 106123473 A 11/2016
CN 210951948 U 7/2020
(Continued)

OTHER PUBLICATIONS

DE 10 32 130 (English translation) (Year: 2001).*
(Continued)

*Primary Examiner* — Jonathan Bradford
(74) *Attorney, Agent, or Firm* — Dinsmore & Shohl LLP

(57) ABSTRACT

A wine cellar drawer for storing, displaying and cooling bottles, in particular beverage bottles like wine bottles. The wine cellar drawer has a drawer assembly with a drawer housing and a drawer, as well as a cooling unit for cooling the inner of the wine cellar drawer and the inner of the drawer. The various components of the cooling unit are provided at the back of the drawer housing. A condenser of the cooling unit is provided outside the drawer housing and behind the drawer housing with respect to the sliding direction of the drawer, while an evaporator of the cooling unit is provided within the back of the drawer housing. The condenser and the evaporator are positioned side by side with respect to a direction perpendicular to the sliding direction of the drawer within the horizontal extension plane of the wine cellar drawer.

24 Claims, 9 Drawing Sheets

(51) Int. Cl.

| | |
|---|---|
| ***A47B 77/08*** | (2006.01) |
| ***A47B 77/16*** | (2006.01) |
| ***F25D 25/02*** | (2006.01) |

(56) References Cited

U.S. PATENT DOCUMENTS

| | | | | |
|---|---|---|---|---|
| 2005/0236946 | A1 | 10/2005 | LeClear et al. | |
| 2008/0103939 | A1 | 5/2008 | Gibb | |
| 2015/0075192 | A1* | 3/2015 | Wasa | F24F 11/42 62/80 |
| 2017/0051967 | A1 | 2/2017 | Tierney et al. | |
| 2020/0208896 | A1 | 7/2020 | Yee et al. | |

FOREIGN PATENT DOCUMENTS

| | | | | |
|---|---|---|---|---|
| CN | 211048801 | | * | 7/2020 |
| CN | 211650915 | U | | 10/2020 |
| CN | 217510116 | U | | 9/2022 |
| DE | 10032130 | A1 | | 2/2001 |
| DE | 102005056245 | A1 | | 6/2007 |
| DE | 202007010818 | U1 | | 1/2009 |
| DE | 102011100713 | A1 | | 11/2012 |
| DE | 102011100722 | A1 | | 11/2012 |
| DE | 102013214070 | A1 | | 1/2015 |
| DE | 202023101319 | U1 | | 6/2023 |
| EP | 1652157 | A1 | | 5/2006 |
| EP | 4050287 | A1 | | 8/2022 |
| EP | 4191170 | A2 | | 6/2023 |
| FR | 2777985 | A1 | | 10/1999 |
| GB | 967258 | A | | 8/1964 |
| JP | 1723642 | S | | 8/2022 |
| JP | 1723643 | S | | 8/2022 |
| JP | 1723644 | S | | 8/2022 |
| KR | 20060049608 | A | | 5/2006 |
| KR | 101005207 | B1 | | 12/2010 |
| KR | 20190099870 | A | | 8/2019 |
| KR | 102225075 | B1 | | 3/2021 |
| WO | WO2010131814 | A1 | | 11/2010 |
| WO | WO2022179741 | A1 | | 9/2022 |

OTHER PUBLICATIONS

China Application No. 202130559794.6 titled "A drawer for storing wine" filed on Aug. 26, 2021.
China Application No. 202130559792.7 titled "A drawer for storing wine" filed on Aug. 26, 2021.
Extended European Search Report Issued in European Application No. 21159510.3 mailed on Aug. 2, 2021.
European Union Application No. 008444491-0001-0007 titled "Syrah—Wine Cellar Drawer DrawBar" filed on Feb. 26, 202.
European Patent Application No. 21159510.3 titled "Wine Cellar Drawer, Wine Cabinet and Kitchen Cabinet" filed on Feb. 26, 2021.
United Kingdom Application No. 6156847 titled "Syrah—Wine Cellar Drawer" filed on Aug. 25, 2021.
United Kingdom Application No. 6156848 titled "Syrah—Wine Cellar Drawer" filed on Aug. 25, 2021.
United Kingdom Application No. 6156849 titled "Syrah—Wine Cellar Drawer" filed on Aug. 25, 2021.
United Kingdom Application No. 6156850 titled "Syrah—Wine Cellar Drawer" filed on Aug. 25, 2021.
United Kingdom Application No. 6156851 titled "Syrah—Wine Cellar Drawer" filed on Aug. 25, 2021.
United Kingdom Application No. 6156852 titled "Syrah—Wine Cellar Drawer" filed on Aug. 25, 2021.
United Kingdom Application No. 6156853 titled "Syrah—Wine Cellar Drawer" filed on Aug. 25, 2021.
Japan Application No. 2021-018374 titled "Drawer with Refrigerating Function" filed on Aug. 26, 2021.
Japan Application No. 2021-018375 titled "Drawer with Refrigerating Function" filed on Aug. 26, 2021.
Japan Application No. 2021-018376 titled "Drawer with Refrigerating Function" filed on Aug. 26, 2021.
Notification of Registration Issued in European Union Application No. 008444491-0001-0007 mailed on Mar. 2, 2021.
PCT Application No. PCT/EP2021/087076 titled "Wine Cellar Drawer, Wine Cabinet and Kitchen Cabinet" filed on Dec. 21, 2021.
Registration Certificate for United Kingdom Application No. 6156847 mailed on Aug. 25, 2021.
Registration Certificate for United Kingdom Application No. 6156848 mailed on Aug. 25, 2021.
Registration Certificate for United Kingdom Application No. 6156849 mailed on Aug. 25, 2021.
Registration Certificate for United Kingdom Application No. 6156850 mailed on Aug. 25, 2021.
Registration Certificate for United Kingdom Application No. 6156851 mailed on Aug. 25, 2021.
Registration Certificate for United Kingdom Application No. 6156852 mailed on Aug. 25, 2021.
Registration Certificate for United Kingdom Application No. 6156853 mailed on Aug. 25, 2021.
Decision for Registration for Japan Application No. 2021-018374 mailed on Jul. 20, 2022.
Decision for Registration for Japan Application No. 2021-018375 mailed on Jul. 20, 2022.
Decision for Registration for Japan Application No. 2021-018376 mailed on Jul. 20, 2022.
Registration Certificate for Japan Application No. 2021-018374 mailed on Aug. 23, 2022.
Registration Certificate for Japan Application No. 2021-018375 mailed on Jul. 20, 2022.
Registration Certificate for Japan Application No. 2021-018376 mailed on Jul. 20, 2022.
Office Action issued in CN Application No. 202130559794.6 mailed on Jul. 10, 2023.
Office Action issued in CN Application No. 202130559792.7 mailed on Jul. 6, 2023.
International Preliminary Report on Patentability for PCT Application No. PCT/EP2021/087076 mailed on Sep. 7, 2023.
Design U.S. Appl. No. 29/805,205 titled "Refrigerated Drawer" filed Aug. 25, 2021.
Office Action issued in CN Application No. 202130559794.6 mailed on Sep. 27, 2023.
CN Application No. 202180094464.1 titled "Wine Cellar Drawer, Wine Cabinet and Kitchen Cabinet" filed on Aug. 23, 2023.
Office Action issued in EP Application No. 21159510.3 mailed on Nov. 6, 2023.
Registration Certificate for Chinese Application No. 202130559794.6 mailed on Dec. 22, 2023.
Registration Certificate for Chinese Application No. 202130559792.7 mailed on Jan. 26, 2024.
European Patent Office; International Search Report and Written Opinion for PCT/EP2021/087076 mailed May 20, 2022.
Office Action issued in CN Application No. 202180094464.1 mailed on May 6, 2026.

* cited by examiner

WINE CELLAR DRAWER, WINE CABINET AND KITCHEN CABINET

CLAIM TO PRIORITY

This 35 U.S.C. § 371 National Stage Patent application claims priority to and benefit of PCT Patent Application No. PCT/EP2021/087076, filed Dec. 21, 2021, which claims priority to EP21159510.3 filed Feb. 26, 2021, all of which is incorporated by reference herein.

BACKGROUND

Present embodiments relate to a wine cellar drawer, to a wine cabinet comprising at least one wine cellar drawer and to a kitchen cabinet comprising at least one wine cellar drawer.

Wine cellar drawers in the sense of the present disclosure are drawer configurations, which are configured in a highly specialized manner for storing, displaying and cooling beverage bottles, but can be used as well for any other type of beverages having a bottle-shape, and in particular wine bottles, being in the following generalized as beverage bottles. Common wine cellar drawers have a drawer assembly with a drawer housing and a drawer positioned within the drawer housing. The drawer housing is configured to be mounted in a cavity of a cabinet. Such a cabinet can for example be a receiving cavity in a common kitchen cabinet or a receiving cavity in a specialized wine cabinet. The drawer is coupled to the drawer housing in such a manner that it can move along a sliding direction of the drawer with respect to the drawer housing. Typically, the drawer can be moved between an extended position, in which the drawer at least partly protrudes out from the drawer housing, and a retracted position, in which the drawer is positioned within the drawer housing. The drawer is configured to receive and to hold beverage bottles within the wine cellar drawer. Moreover, a wine cellar drawer commonly comprises a cooling unit defining a refrigerant circuit and configured to cool the inner of the drawer housing and in particular the inner of the drawer, where the beverage bottles are to be stored. The cooling unit generally comprises a plurality of components and in particular at least one compressor, one condenser and one evaporator coupled to each other in such a manner that these components form said refrigerant circuit. Finally, such wine cellar drawers are provided with a control unit configured to control the operation of the cooling unit and in particular the operation of the compressor.

Although, known implementations of such wine cellar drawers are quite functional, the provided cooling units often require much space. This circumstance results either in less space for beverage bottles within the wine cellar drawer or in undesirable big and in particular high configurations for the overall wine cellar drawer. Alternatively, the provided cooling unit could be scaled down. This, however, often results in an undesirable drop in the cooling capacity of the cooling unit resulting in insufficient cooling for the stored beverage bottles.

In view of these issues, the problem to be solved to provide a configuration for a wine cellar drawer having quite small overall dimensions, while still offering room for storing beverage bottles within the wine cellar drawer in combination with enhanced cooling capacities.

This problem is solved by a wine cellar drawer according to independent claim 1. Further features for the wine cellar drawer according to the present disclosure can be taken from the dependent claims. Besides, the present disclosure refers to a wine cabinet and a kitchen cabinet comprising the wine cellar drawer according to the present disclosure.

SUMMARY

According to some embodiments, in the wine cellar drawer described above the various components of the cooling unit are provided at the back of the drawer housing in such a way that the condenser is provided outside the drawer housing and behind the drawer housing with respect to the sliding direction of the drawer, while the evaporator is provided within the back of the drawer housing. Furthermore, the condenser and the evaporator are positioned side by side with respect to a direction perpendicular to the sliding direction of the drawer within the horizontal extension plane of the wine cellar drawer.

Providing the condenser outside the drawer housing allows an improved temperature exchange at the condenser with the environment of the wine cellar drawer which is in particular not limited by the dimensions of a further provided air flow channel connecting a condenser positioned in the inner of the drawer housing with the outer environment. At the same time, providing the evaporator inside the drawer housing allows an improved temperature exchange at the evaporator with the air from the inner of the wine cellar drawer which is in particular not limited by the dimensions of another further provided air flow channel connecting an evaporator outside the drawer housing with the inner of the drawer housing. Finally, positioning the condenser and the evaporator not one behind the other in the sliding direction as it is commonly the case, but positioning them side by side allows to reduce the space which is required by the cooling unit along the sliding direction of the wine cellar drawer. Thus, the formed cooling unit is quite short along the sliding direction such that the free space for storing beverage bottles within the wine cellar drawer is not or at least less limited by the provided cooling unit.

Further, all components of the cooling unit, like the compressor, the condenser and the evaporator are provided substantially side by side along the direction perpendicular to the sliding direction of the drawer within the horizontal extension plane of the wine cellar drawer. Thus, not only the condenser and the evaporator of the cooling unit are provided in a space saving configuration but also the other components of the cooling unit.

The cooling unit further comprises a condenser fan unit with an air inlet and an air outlet. The condenser fan unit is directing in said direction perpendicular to the sliding direction of the drawer within the horizontal extension plane of the wine cellar drawer. In other words, the air inlet and the air outlet of the condenser fan unit are positioned along said direction perpendicular to the sliding direction of the drawer within the horizontal extension plane of the wine cellar drawer. Such a condenser fan unit allows to enhance the temperature exchange at the condenser of the cooling unit. And due to the specific orientation for the condenser fan unit, the cooling unit has a short extension in the sliding direction of the drawer. Further, both of the air inlet and the air outlet of the condenser fan unit are covered or enclosed by the condenser, which allows to further enhance the temperature exchange at the condenser resulting in a very efficient and thus space saving overall configuration.

The condenser is formed in a S-shape seen along a direction perpendicular with respect to the horizontal extension plane of the wine cellar drawer. Such a S-shape provides a large surface of the condenser for temperature exchange and, thus, a substantially increased efficiency of the condenser, while still having a very compact configuration of the overall cooling unit.

Further, at least one component of the cooling unit, in particular the compressor, is positioned within the S-shaped condenser seen along the direction perpendicular with respect to the horizontal extension plane of the wine cellar drawer. Such a configuration provides a very space saving overall structure of the cooling unit.

The condenser comprises pipe loops. The pipe loops are stacked in said direction perpendicular with respect to the horizontal extension plane of the wine cellar drawer and formed in a S-shape seen along the direction perpendicular with respect to the horizontal extension plane of the wine cellar drawer. This configuration provides a high temperature exchange efficiency for the condenser while providing a very compact overall structure at the same time.

At least one component of the cooling unit, in particular the compressor of the cooling unit, is positioned within the S-shaped pipe loops of the condenser seen along the direction perpendicular with respect to the horizontal extension plane of the wine cellar drawer. Such a configuration is quite compact.

The cooling unit comprises an evaporator fan unit directing in the sliding direction of the drawer. Thus, the evaporator fan unit is oriented perpendicular with respect to the condenser fan unit if provided in the above described manner. Providing such an evaporator fan unit with an orienting in said manner provides an enhanced temperature exchange at the evaporator and, thus, an improved efficiency of the cooling unit allowing to scale down the overall cooling unit while still providing the desired cooling power. Further, the evaporator fan unit is provided in the back of the drawer housing at the evaporator, which results in a quite efficient but compact overall configuration.

Further, the evaporator fan unit has an evaporator fan unit housing defining at least one cavity. The cavity is formed and positioned such that in the retracted position of the drawer a top end of at least one bottle stored within the drawer can protrude at least partly into the cavity. This enables a very compact configuration for the overall wine cellar drawer while improving the cooling efficiency of the cooling unit.

The front side of the wine cellar drawer for the cooling unit does not comprise a separate vent channel. In other words, the wine cellar drawer is configured such that the temperature exchange of the cooling unit with the environmental air occurs directly at the back of the wine cellar drawer, but not at the front thereof. Thus, the space for providing a separate vent channel leading from the back of the wine cellar drawer to the front thereof can be saved. This allows a quite compact configuration for the overall wine cellar drawer.

The drawer comprises positioning means, which are configured to hold bottles of various sizes and shapes in position within the drawer. Such positioning means improve the handling of the wine cellar drawer as the bottles are fixed reliably within the drawer. Further, the position means have sliding stoppers configured to reduce or even prevent sliding of the bottles within the drawer when moving the drawer. Thus, damages to the bottles and/or the wine cellar drawer as well as undesired noise from back and forth sliding and abutting bottles can be prevented or at least reduced substantially. Such sliding stoppers in particular can be formed at least partly from elastic materials like rubber.

The wine cellar drawer is configured such that bottles having a diameter of up to 96 mm can be stored therein. Thus, the wine cellar drawer can be loaded with bottles of the most common sizes in use resulting in a high flexibility for using the wine cellar drawer.

The wine cellar drawer is of compact size providing an overall height of about 14 cm. Such an overall height is quite small and allows to position the formed wine cellar drawer in various receiving cavities in any cabinet.

The drawer housing of the wine cellar drawer comprises at least one insulation layer configured to isolate various components of the wine cellar drawer from the environment of the wine cellar drawer. Thus, the cooling efficiency of the wine cellar drawer can be improved, while other devices in the vicinity of the wine cellar drawer can be shielded thermally from said components of the wine cellar drawer. Further, the at least one insulation layer is formed at least partially, in particular completely, of heat resistant material like fiberglass wool or other suitable materials. This holds in particular for sections of any insulation layer positioned near components of the cooling unit which become hot during operation of the cooling unit or near components of said other devices from which the wine cellar drawer should be shielded thermally.

The drawer housing is provided with an upper insulation layer and/or a lower insulation layer having a height of about 15 mm to 22 mm and in particular of 18 mm to 19 mm. Such an insulation layer provides suitable insulation characteristics while not requiring too much space.

The drawer housing of the wine cellar drawer has at least one insulation layer comprising at least one, in particular several, vacuum insulated panel. Such vacuum insulated panels allow to form well insulated and space saving configurations.

Further, the vacuum insulated panels are arranged asymmetrically on the upper side and on the lower side of the wine cellar drawer with respect to the horizontal extension plane of the wine cellar drawer. Such a configuration provides a very efficient and well adapted configuration for the overall wine cellar drawer.

The wine cellar drawer comprises a user interface coupled to the control unit. The user interface is arranged and configured to display relevant operation parameters and/or state information of the wine cellar drawer to a user and/or to receive and to forward operation commands input by the user to the control unit. Such a user interface is quite functional for the wine cellar drawer.

Further, the wine cellar drawer comprises at least one temperature sensor coupled to the control unit and configured to measure a temperature within the drawer housing, in particular within the drawer. The user interface comprises a display configured to indicate the current temperature measured by said temperature sensor. Such a configuration provides a facilitated operability of the wine cellar drawer as the user gets operational feedback directly.

Further, the user interface comprises at least one control panel having at least one input section, for example comprising buttons and/or a touch-screen, configured to receive operation commands from a user and to forward the operation commands to the control unit. Further preferably, said input section comprises a power button for switching on and off the cooling unit. Further, said input section comprises at least one target temperature adjustment button for adjusting the target temperature within the drawer housing and in particular within the drawer of the wine cellar drawer. Said control panel in particular comprises a display section indicating the currently set target temperature. Such configurations improve the operability of the wine cellar drawer.

The wine cellar drawer comprises at least one sensor for obtaining information about the current state of the wine cellar drawer. The at least one sensor is coupled to the control unit and is configured to receive and to process information from said sensor and, based on this information, to set the operation parameters for the cooling unit. In particular, one of said sensors is a temperature sensor configured to measure the temperature of any component of the cooling unit, the temperature within the drawer housing and in particular within the drawer of the wine cellar drawer or the temperature in the vicinity of the wine cellar drawer. Such sensors facilitate the optimized operation of the wine cellar drawer.

The wine cellar drawer comprises a motion sensor coupled to the control unit. The motion sensor is configured to sense whether there is a person and/or any movement within the vicinity of the wine cellar drawer. The control unit is configured such that it prevents fan units of the wine cellar drawer, like the condenser fan unit and/or evaporator fan unit, and/or the compressor from starting when someone is in the vicinity of the wine cellar drawer. Thus, any noise from starting said components is prevented as long as a user is in the vicinity of the wine cellar drawer.

According to a further aspect of the present disclosure, a wine cabinet comprises at least one wine cellar drawer as described above and in particular several of said wine cellar drawers combined with each other to form the wine cabinet. Thus, the various advantages achieved by the above described wine cellar drawer can be transferred to a wine cabinet.

According to another aspect, a kitchen cabinet comprises at least one typical built-in device like an oven, a refrigerator, a freezer, a micro wave, a coffee machine, a vacuum sealer, just a simple compartment or a simple drawer, and at least one wine cellar drawer as described above. Thus, the various advantages achieved by the wine cellar drawers can be transferred to a common kitchen cabinet.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
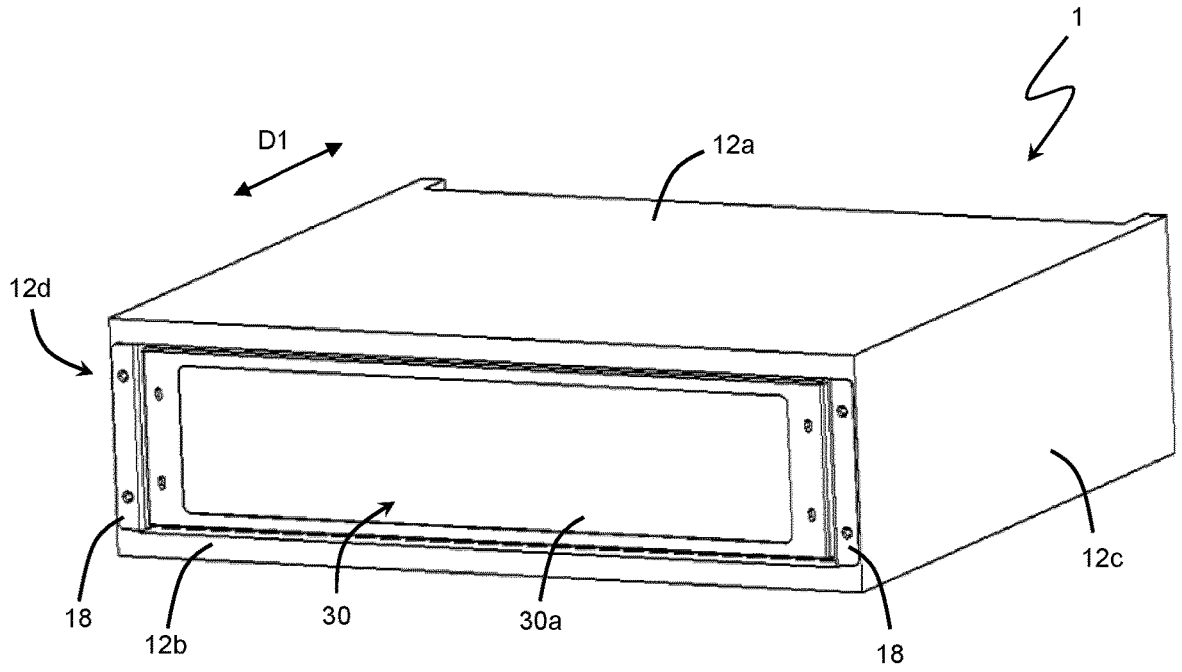
FIG. 1A is a perspective diagonal front view of an exemplary embodiment of a wine cellar drawer according to the present invention surrounded by cabinet walls.

Exemplary embodiments will now be described with reference to the accompanying drawings, wherein identical or at least similar reference numerals designate identical elements throughout the various drawings.

Figure 1B:
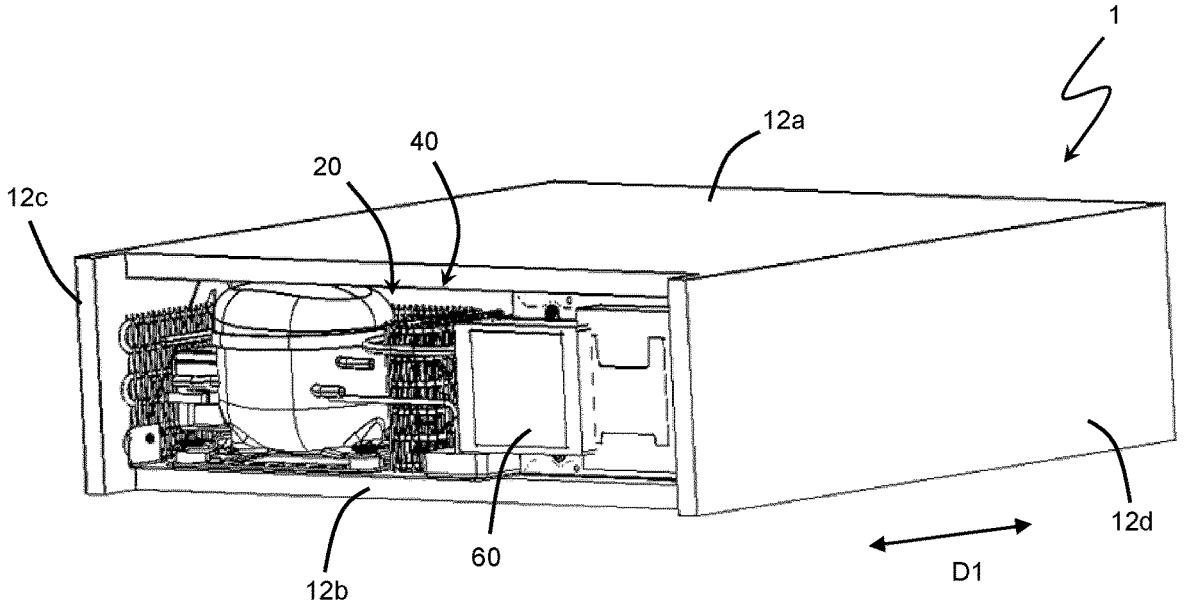
FIG. 1B is a perspective diagonal back view of the wine cellar drawer of FIG. 1A together with said cabinet walls.

As can be seen for example in FIGS. 1A and 1B, a wine cellar drawer 1 has a quite flat rectangular shape. Here, the wine cellar drawer 1 is illustrated together with cabinet walls 12*a*, 12*b*, 12*c* and 12*d* surrounding the wine cellar drawer 1. The wine cellar drawer 1 is positioned within the cabinet walls 12*a* to 12*d* and coupled thereto via mounting brackets 18 and appropriate fastening means (not illustrated). The illustrated wine cellar drawer 1 has a height of 14 cm as often drawer receiving cavities provided in cabinets offer exactly this specific height for drawers to be inserted therein. However, also other heights are possible.

Figure 2A:
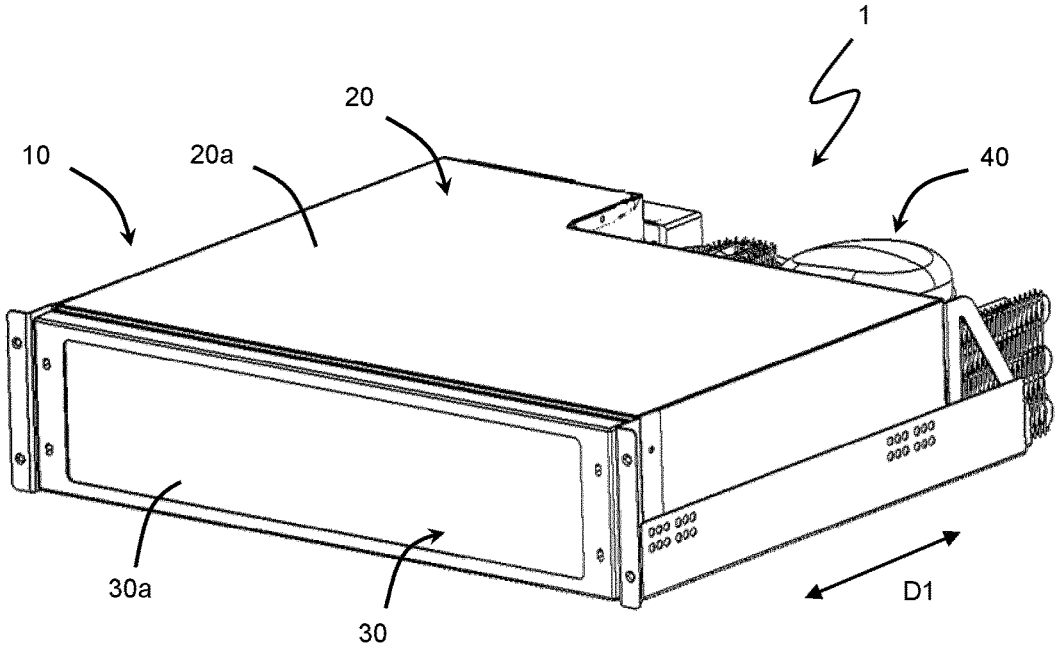
FIG. 2A is a perspective diagonal front view of the wine cellar drawer of FIGS. 1A and 1B without the cabinet walls.
Figure 2B:
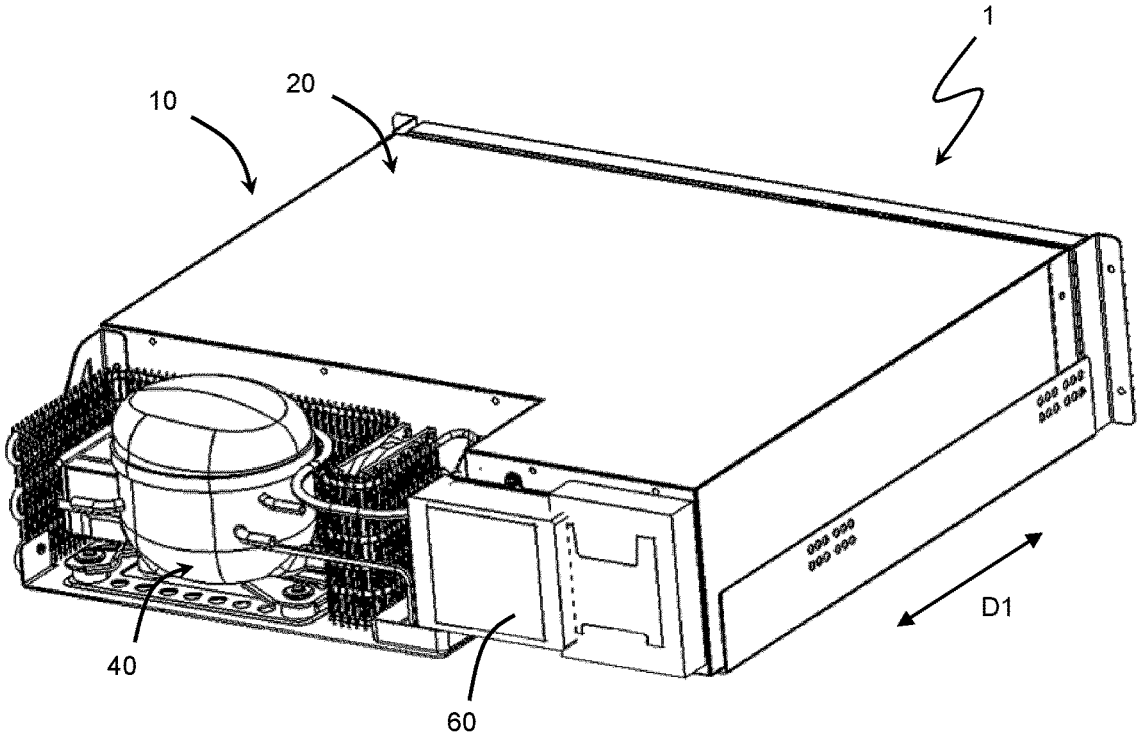
FIG. 2B is a perspective diagonal back view of the wine cellar drawer of FIG. 2A.

As can be seen in particular in FIGS. 2A and 2B, the wine cellar drawer 1 comprises a drawer assembly 10 having a drawer housing 20 and a drawer 30 positioned within the drawer housing 20. The drawer 30 is configured to be moved with respect to the drawer housing 20 in a sliding direction D1 between a retracted position and an extended position. Here, the drawer 30 is depicted in the retracted position. The drawer 30 has a front panel 30*a* on its front side. In the illustrated embodiment, a top housing wall 20*a* of the drawer housing 20 comprises an insulation layer. Here, the insulation layer is formed of vacuum insulated panels formed of heat resistant material and having a height of about 19 mm. The top housing wall 20*a* is provided in an asymmetrical configuration to form an efficient and space saving arrangement. Also the other walls of the drawer housing 20 are provided with insulation layers in a similar manner.

As can be seen in particular in FIG. 1B, the wine cellar drawer 1 further comprises a cooling unit 40 provided at the back of the drawer housing 20, i.e. behind the drawer 30 along the sliding direction D1. The specific configuration of said cooling unit 40 will be described in more detail later. Nevertheless, one can see in FIG. 1B that in the illustrated embodiment, at least some components of the cooling unit 40 are positioned behind the drawer housing 20. Moreover, the wine cellar drawer comprises a control unit 60, which is configured to control the cooling unit 40. The control unit 60 is also provided at the back side of the wine cellar drawer 1.

Figure 3A:
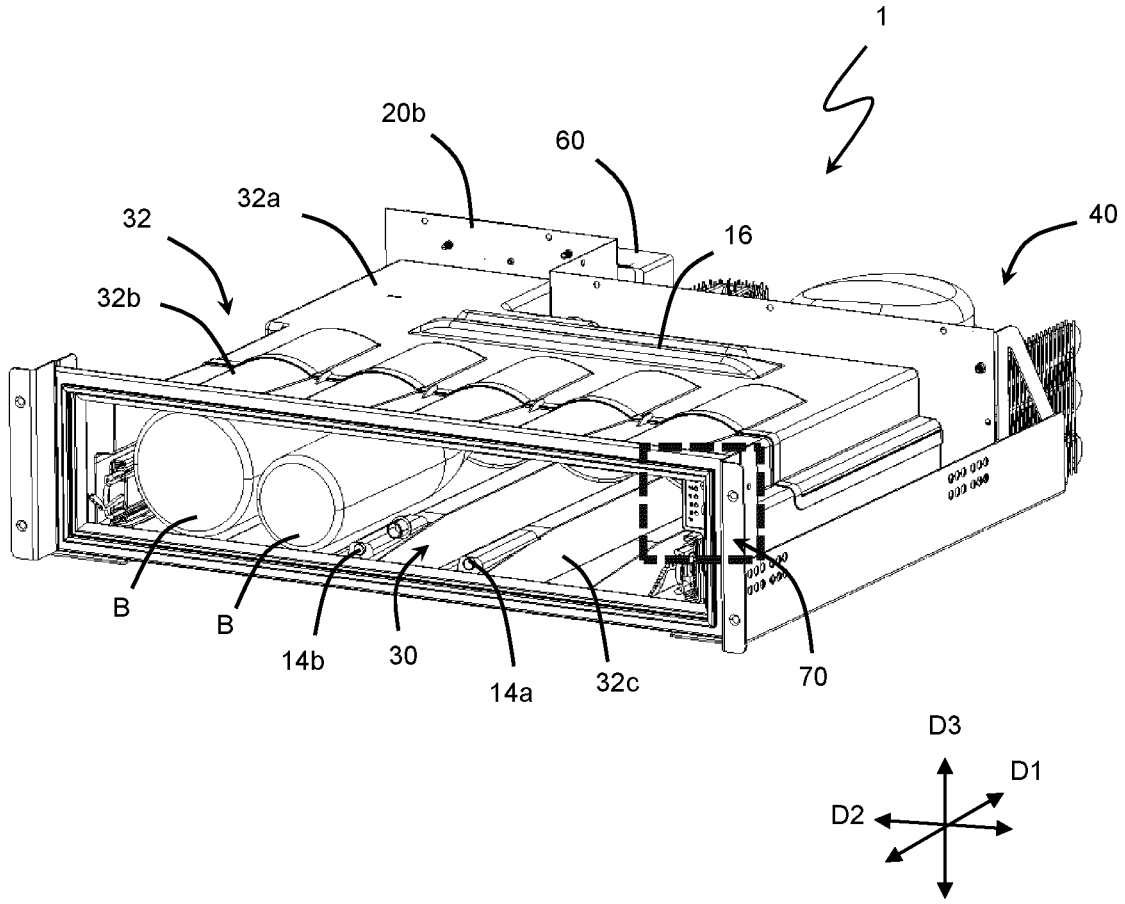
FIG. 3A is a perspective diagonal front view of the wine cellar drawer of FIGS. 2A and 2B with the top housing wall and the therein provided insulation layer as well as the front panel being omitted.
Figure 3B:
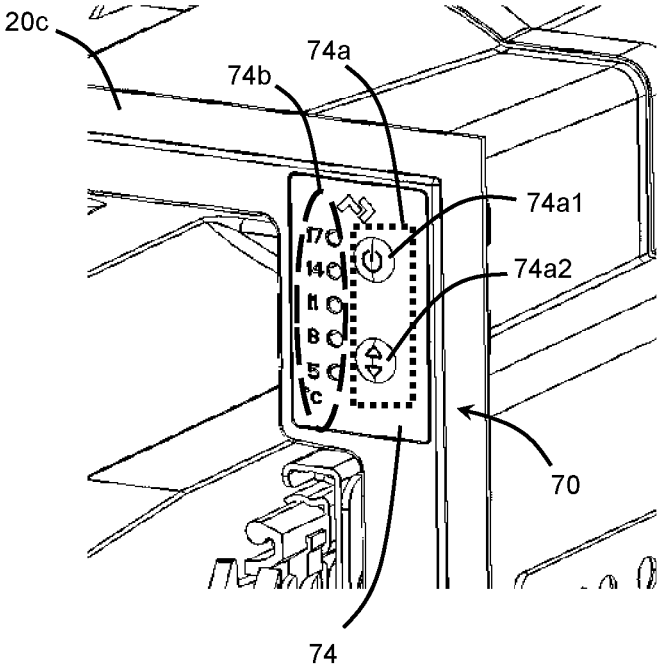
FIG. 3B is an enlarged partial view of the wine cellar drawer of FIG. 3A.

In the following, it is referred to FIGS. 3A and 3B. Here, FIG. 3A shows the wine cellar drawer 1 of the above drawings with the top housing wall 20*a* of the drawer housing 20 and the front panel 30*a* being omitted. FIG. 3B shows an enlarged version of the partial section in FIG. 3A indicated by the dashed line.

As can be seen best in FIG. 3A, the drawer 30 is configured to receive and store beverage bottles B. To be able to hold these bottles in an appropriate manner, the drawer 30 comprises positions means comprising various sliding stoppers 32*a*, 32*b* and 32*c*. The first sliding stopper 32*a* and the second sliding stopper 32*b* are formed as cover plates having receiving sections configured such that at least the big one of the bottles B having a diameter of 96 mm is received in a formfitting manner therein. The first sliding stopper 32*a* and the second sliding stopper 32*b* are coupled to each other to form an upper wall of the drawer 30. The third sliding stopper 32 is configured as bottom plate of the drawer 30 having also corresponding receiving sections for receiving and holding the bottles B. The overall positioning means 30 is configured such that bottles of various sizes and shapes can be hold therewith. This can be achieved by varying the shapes and/or the material of the various components 32*a*, 32*b* and 32*c* of the positions means 30. A skilled artisan will be able to think of concrete implementations for this configuration without going in further detail here.

Referring to FIG. 3B, one can see that the wine cellar drawer 1 is provided with a user interface 70. This user interface 70 is coupled to the control unit 60 to communicate therewith. Moreover, the user interface 70 is configured to display operation parameters and/or state information of the wine cellar drawer 1 and in particular of the cooling unit to a user and/or to receive and to forward operation commands input by a user to the control unit 60. For this purpose, the user interface 70 is coupled to a front frame 20*c* of the drawer housing 20 such that a user can reach the user interface 70 at least in a state in which the drawer 20 is in the extended position. The illustrated user interface 70 comprises a control panel 74 having an input section 74*a* (see the dotted rectangular) and a display section 74*b* (see the dashed ellipse). The input section 74*a* comprises a power button 74*a*1 for switching on and off the cooling unit 40 and a target temperature adjustment button 74*a*2 for adjusting the target temperature set for the operation of the cooling unit 40. The display section 74*b* is provided with several LED lights and thereto related inscriptions. The user interface 70 is configured to inform a user about the currently set target temperature for the operation of the cooling unit 40 by lighting up the corresponding LED light. If the cooling unit 40 is switched off, none of the provided LED lights is light up.

Here, the user interface 70 is implemented in a quite simple manner. Nevertheless, also more complex implementations thereof like with multi-functional touch-screen displays or similar can be provided.

The wine cellar drawer 1 further comprises several temperature sensors (not marked explicitly in the illustrated drawings) coupled to the control unit 60 and configured to transmit temperature information to the control unit 60. Examples for such temperature sensors are an drawer temperature sensor for determining the temperature within the drawer 30, a vicinity temperature sensor for determining the temperature in the vicinity of the wine cellar drawer 1 and cooling unit components temperature sensors for determining the temperature of various components of the cooling unit 40 like of the compressor 42, the condenser 44, the evaporator 46 or the refrigerant within the formed refrigerant circuit at specific sections within the cooling unit 40. The control unit 60 is configured to receive and to process the temperature information from the various sensors and to control the cooling unit 40 based on the processed temperature information. For example, when the temperature within the drawer 30 is lower than the set target temperature, the control unit 40 can speed up the compressor 42 of the cooling unit 40. If the determined temperature in the vicinity of the wine cellar drawer 1 exceed a predetermined temperature value, the control unit 40 can stop the operation of the cooling unit 40 and instruct the user interface 70 to output a failure signal. Such a failure signal for example could be implemented in a flashing of all of the provided LED lights. Similar thereto, the control unit 40 can stop the operation of the cooling unit 40 and instruct the user interface 70 to output a failure signal as soon as the temperature of any of the components 42, 44, 46 of the cooling unit 40 leaves a predetermined target temperature ranged defined for specific operation states of the cooling unit 40. This holds in particular when the determined temperature for at least one of the components 42, 44 and 46 of the cooling unit 40 exceeds a predetermined threshold value above which damages can occur to the various components 42, 44 and 46 of the cooling unit 40.

Moreover, the wine cellar drawer 1 comprises a motion sensor (not marked explicitly in the illustrated drawings) coupled to the control unit 60 and configured to sense movements and/or the presence of persons within the vicinity of the wine cellar drawer 1, in particular in front of the wine cellar drawer 1. The control unit 60 is configured to prevent the start of the cooling unit 40 or at least of specific components thereof when there is detected a person and/or movement in the vicinity of the wine cellar drawer 1. Thus, it is possible to prevent bothering of a user by noise generated by the respective component(s) of the cooling unit 40.

Of course, the wine cellar drawer 1 can be provided with further or other sensors which are coupled to the control unit 60, wherein the control unit 60 is configured to receive and process various information from said sensors and to control the cooling unit 40 or other components of the wine cellar drawer 1 based on the processed information.

As can be seen in FIG. 3A, the wine cellar drawer 1 comprises further a push-to-open mechanism having two push-to-open components 14*a* and 14*b* to open the drawer 30 such that the drawer 30 does not have to be provided with a separate handle for opening thereof. Furthermore, the wine cellar drawer 1 comprises an illumination bar 16 configured to illuminate the inner of the wine cellar drawer 1 and in particular the inner of the drawer 30. As such components and various implementations therefor are quite known in principle, no further details are provided here.

Figure 4A:
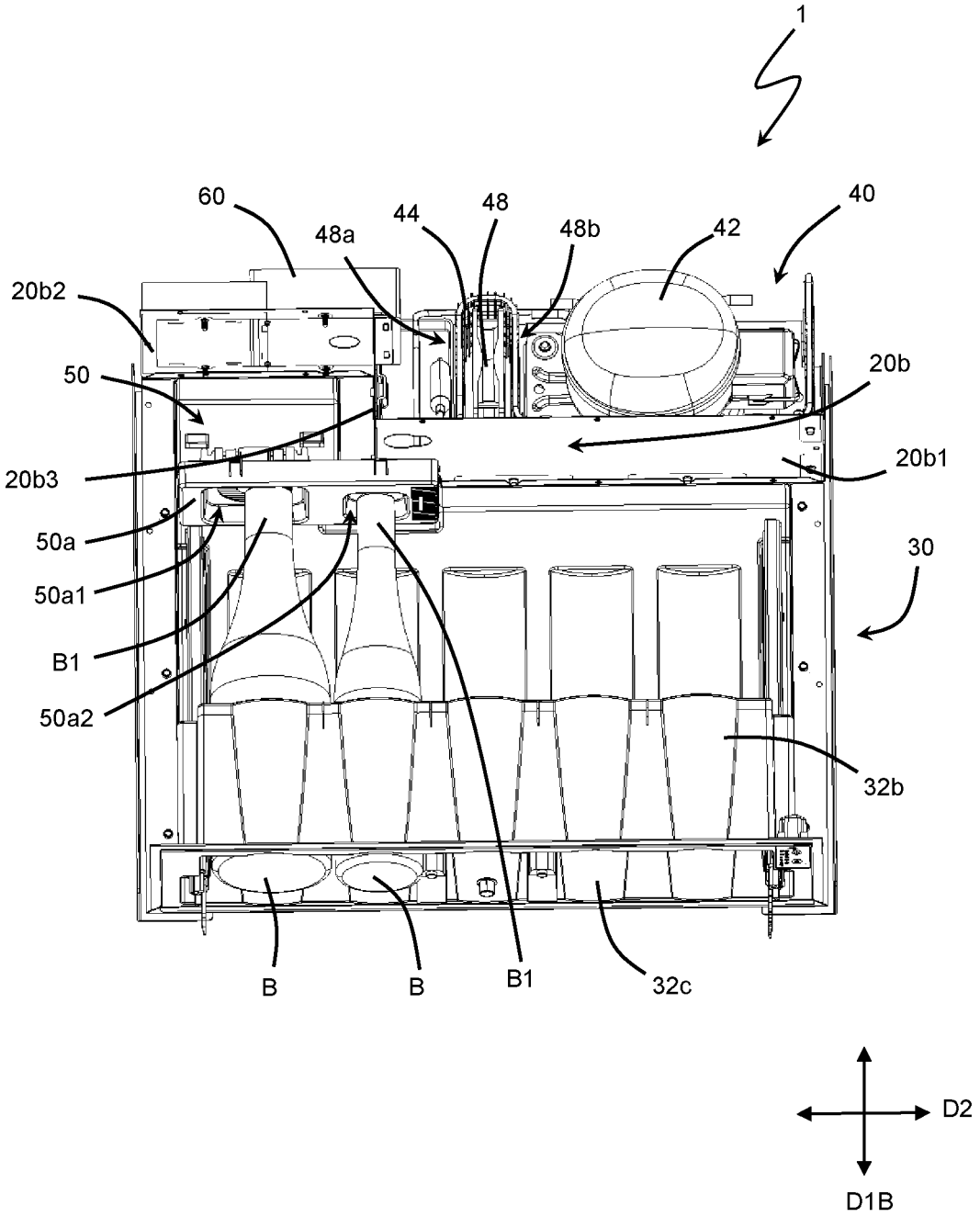
FIG. 4A is a perspective top view of the wine cellar drawer of FIGS. 1A to 3B with further components omitted.
Figure 4B:
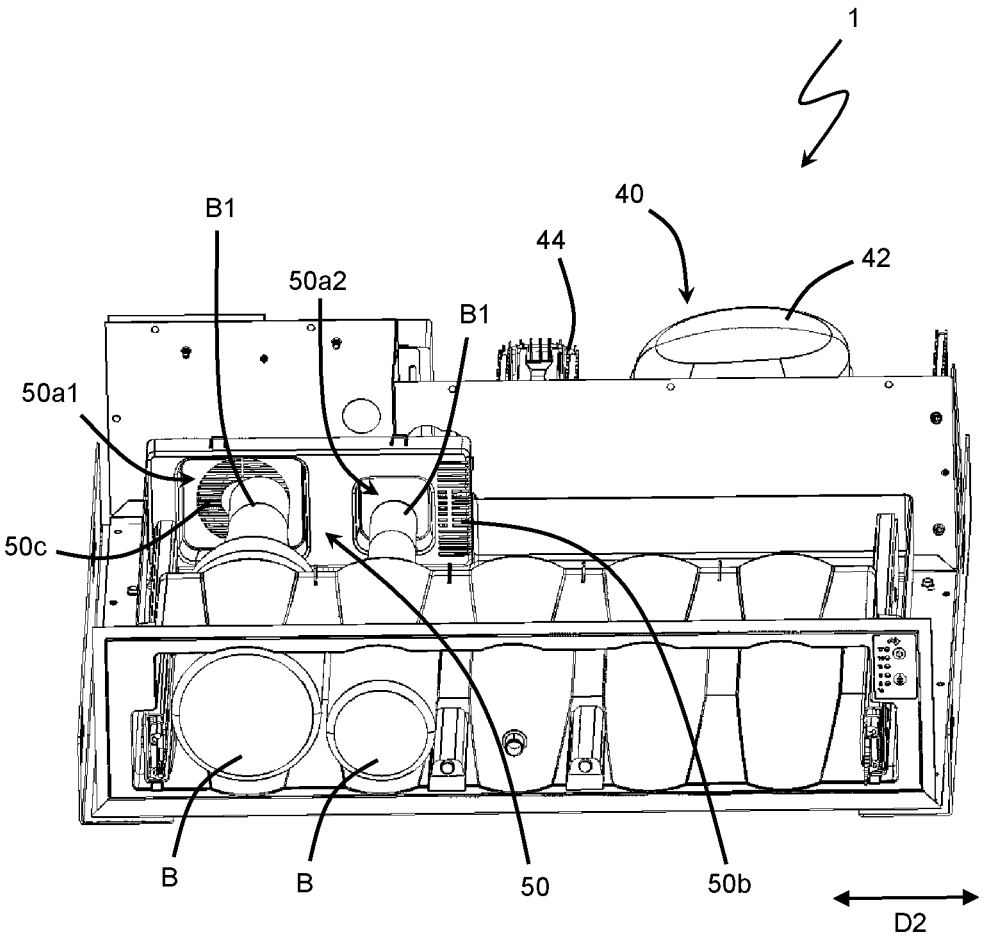
FIG. 4B is a perspective upper front view of the wine cellar drawer of FIG. 4A.
Figure 4C:
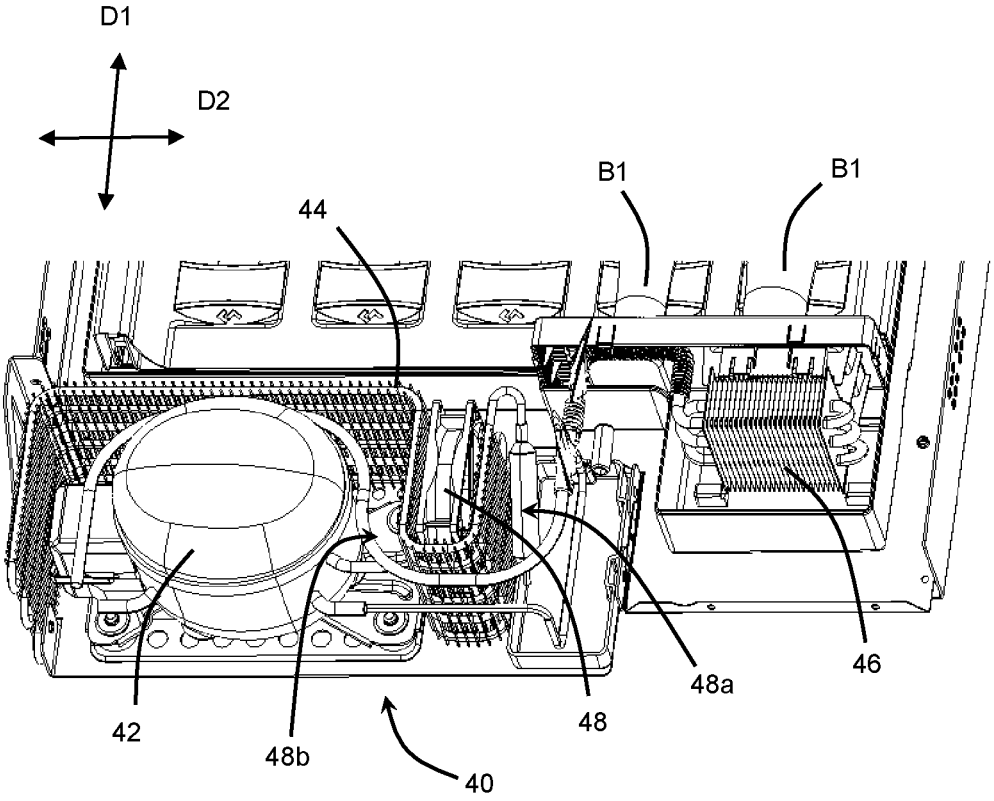
FIG. 4C is a partial perspective upper back view of the wine cellar drawer of FIGS. 4A and 4B.

Now, it is referred in particular to FIGS. 4A to 4C to describe the concrete configuration of the cooling unit 40 in more detail.

As can be seen best in FIG. 4A, the cooling unit 40 is positioned at the back of the drawer housing 20 in particular around a back housing wall 20*b* of the drawer housing 20. In other words, the cooling unit 40 is positioned along the sliding direction D1 behind the drawer 30. The same holds for the control unit 60.

The condenser 44 is positioned behind a first section 20*b*1 of the back housing wall 20*b* and, thus, outside the drawer housing 20. The evaporator 46 is positioned in front a second section 20*b*2 of the back housing wall 20*b* and, thus, within the drawer housing 20. The two sections 20*b*1 and 20*b*2 of the back wall 20*a* are parallel with each other and are shifted with respect to each other along the sliding direction D1. They are connected to each other via a third section 20*b*3 of the back housing wall 20*b* extending along the sliding direction D1 of the drawer 30. The first section 20*b*1 and the second section 20*b*2 of the back housing wall 20*b* extend in a direction D2 perpendicular to the sliding direction D1 of the drawer 30 within the horizontal extension plane of the wine cellar drawer 1. The condenser 44 and the evaporator 46 are positioned side by side in the direction D2 and are separated from each other by the third section 20*b*3 of the back housing wall 20*b*. The control unit 60 is positioned behind the second section 20*b*2 of the back housing wall 20*b* and, thus, also behind the evaporator 46 in the sliding direction D1 of the drawer 30. Thus, the cooling unit 40 is provided in a very space saving configuration along the sliding direction D1 of the drawer 30 such that several bottles B can be positioned in a manner oriented along the sliding direction D1 of the drawer 30 side by side over the whole width of the wine cellar drawer 1.

Here, also the other components of the cooling unit 40 like in particular the condenser 44 is positioned more or less side by side with the condenser 44 and the evaporator 46 along the direction D2 within the horizontal extension plane of the wine cellar drawer 1. This configuration can be seen also quite well in FIG. 4C.

To enhance the temperature exchange capacity at the condenser 44, the cooling unit 40 comprises a condenser fan unit 48 for generating a forced air flow at the condenser 44. Here, the condenser fan unit 48 is arranged to direct in said direction D2 perpendicular to the sliding direction D1. In other words, an air inlet 48*a* of the condenser fan unit 48 and an air outlet 48*b* of the condenser fan unit 48 are positioned along the direction D2 perpendicular to the sliding direction D1 behind each other such that the forced air flow runs through the condenser fan unit 48 along said direction D2. In the illustrated embodiment, both the air inlet 48*a* and the air outlet 48*b* of the condenser fan unit 48 are covered by the condenser 44. This is achieved by surrounding the condenser fan unit 48 on three sides with a U-shaped section of the condenser 44.

Here, the condenser 44 comprises said U-shaped section and an L-shaped section coupled to each other to form an overall S-shape seen along a direction D3 perpendicular with respect to the horizontal plane of the wine cellar drawer 1. The horizontal plane of the wine cellar drawer 1 is defined by the sliding direction D1 and the direction D2 perpendicular with respect to the sliding direction D1. Thus, the three directions D1 to D3 are perpendicular with respect to each other. While said condenser fan unit 48*a* is arranged within the U-shaped section of the condenser 44 and, thus, within a first arc of the formed S-shape, the compressor 42 is arranged within the L-shaped section and, thus, within a second arc of the formed S-shape. Also, other components of the cooling unit like an expansion valve can be positioned within the S-shaped condenser 44. Such a configuration results in a very space saving overall implementation for the cooling unit 40 while having still a very high cooling capacity due to the large surface of the condenser 44 and due to the provided condenser fan unit 48.

As can be seen in particular in FIG. 4C, the condenser 44 comprises various pipe loops being stacked in the direction D3 perpendicular with respect to the horizontal plane of the wine cellar drawer 1. Thus, the surface of the condenser 44 is increased further to enhance the temperature exchange capacity at the condenser 44.

The cooling unit 40 comprises further an evaporator fan unit 50 configured to generate a forced air flow along the sliding direction D1 and, thus, directing in the sliding direction D1. Said evaporator fan unit 50 is positioned at the evaporator 46 in the back of the drawer housing 20 and comprises an evaporator fan unit housing 50*a*. The evaporator 46 is arranged within said evaporator fan unit housing 50*a*. The evaporator fan unit housing 50*a* defines two cavities 50*a*1 and 50*a*2, wherein a first cavity 50*a*1 of these is provided with an outlet opening 50*c* allowing an air flow from the inner of the evaporator fan unit housing 50*a* into the inner of the drawer 30. A further provided inlet opening 50*b* within the evaporator fan unit housing 50*a* allows an air flow from the inner of the drawer 30 into the evaporator fan unit housing 50*a* and thus to the evaporator 46 for heat exchange therewith.

Both cavities 50*a*1 and 50*a*2 are formed and positioned such that top ends B1 of bottles B positioned within the drawer 30 can protrude at least partially into the two cavities 50*a*1 and 50*a*2 in the retracted position of the drawer. Thus, even quite long bottles B can be stored within the wine cellar drawer, while the bottles B are cooled efficiently.

At this point, it is to be noted that the wine cellar drawer 1 is not provided with a separate vent channel from the back of the wine cellar drawer 1 to the front thereof to provide the various components of the cooling unit 40 and in particular the condenser 44 thereof with fresh air. Such a configuration is possible due to the positioning of the condenser 44 outside the drawer housing 20 and, thus, due to the direct contact of the condenser with fresh air from the environment. At the same time, the overall cooling efficiency of the cooling unit 40 is quite high due to the positioning of the evaporator 46 in the inner of the drawer housing 20. Thus, not just the condenser 44 and the evaporator 46 are decoupled from each other thermally by the drawer housing 20 but also the air paths are quite short. This allows to reduce the negative influence of long vent channels on the cooling capacity of the cooling unit 40.

Figure 5A:
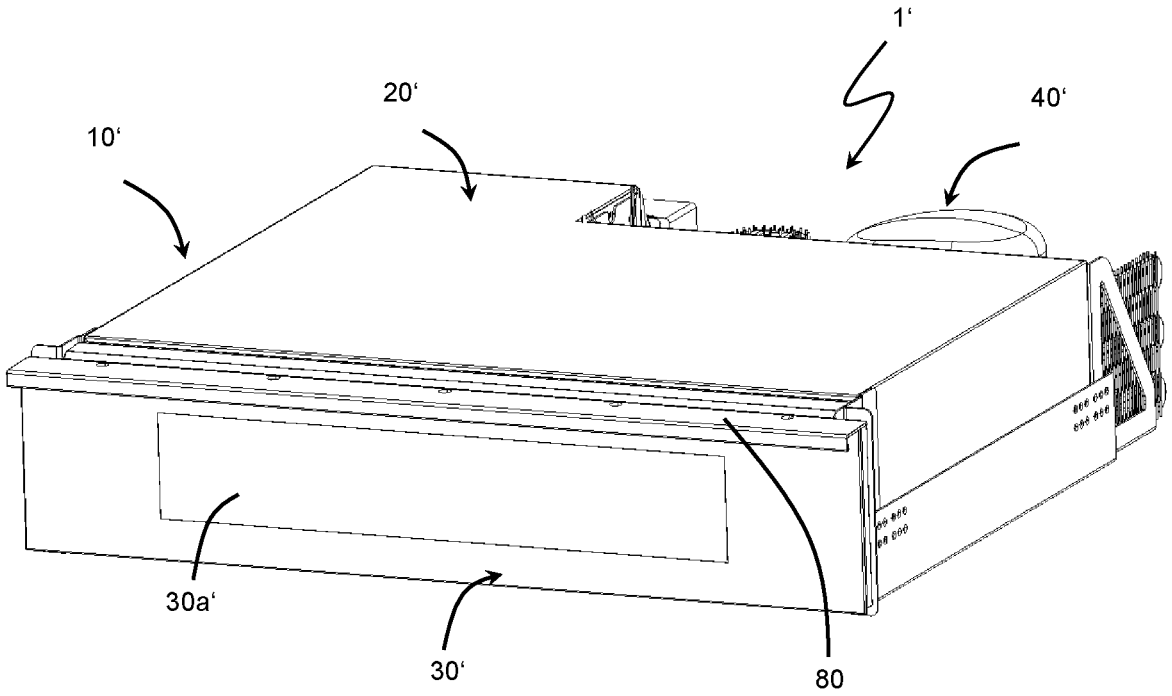
FIG. 5A is a is a perspective diagonal front view like FIG. 2A of a wine cellar drawer according to a second embodiment of the present invention.
Figure 5B:
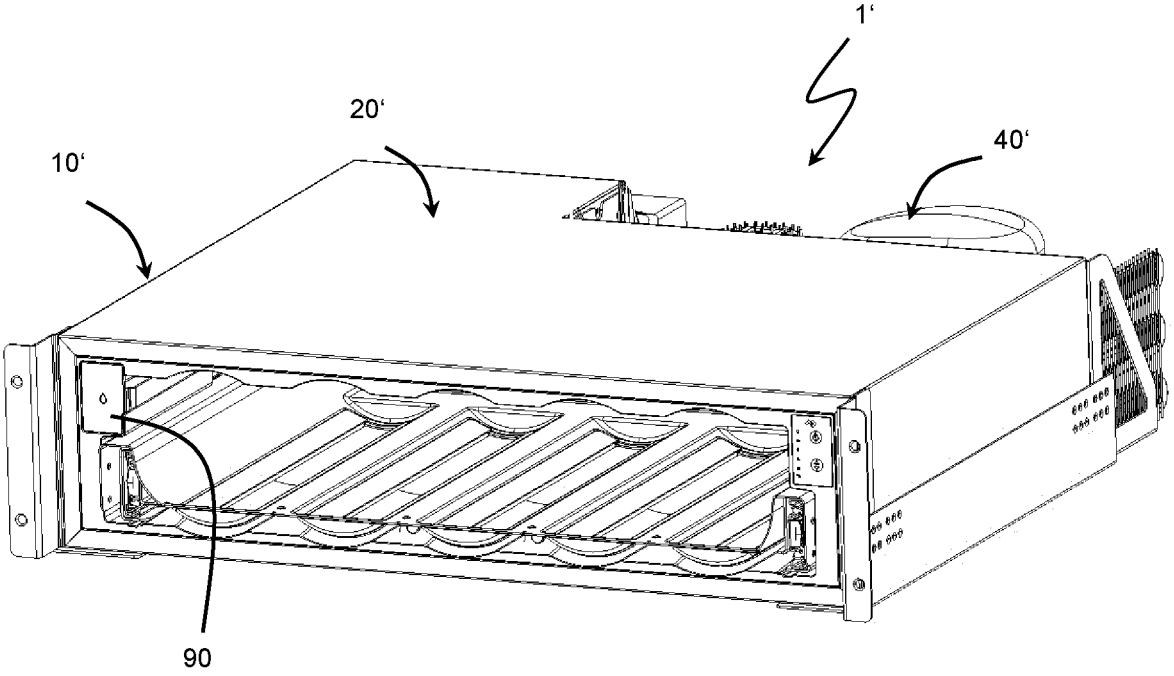
FIG. 5B is a perspective diagonal front view of the wine cellar drawer of FIG. 5A with the front panel being omitted.

FIGS. 5A and 5B show a wine cellar drawer 1' according to another exemplary embodiment of the present invention. The structural configuration of this second embodiment with a drawer assembly 10', a drawer housing 20', a drawer 30' and a cooling unit 40' is quite similar to the one of the first embodiment.

However, in contrast to the first embodiment, a front panel 30*a*' of the second embodiment is provided with a window allowing to see the inner of the wine cellar drawer 1' also in the closed state of the drawer 30'. Moreover, the drawer 30' is provided with a handle 80 for operating the drawer 30'.

Figure 6:
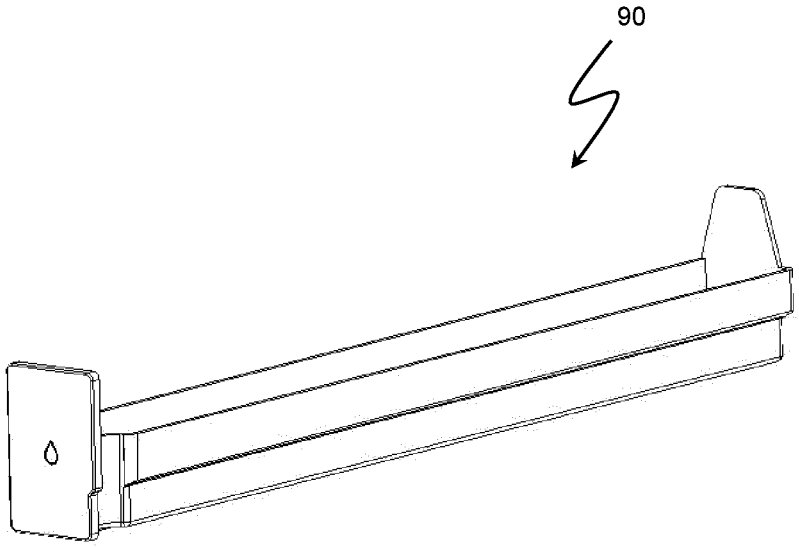
FIG. 6 is a perspective diagonal front view of the humidifier of the wine cellar drawer of FIGS. 5A and 5B.

Finally, the wine cellar drawer 1' according to the second embodiment further comprises a humidifier 90 positioned within the drawer housing 20'. The humidifier 90 is configured to receive and to store water to provide sufficient humidity within the wine cellar drawer 1'. The wine cellar drawer 1' is configured such that the humidifier 90 can be removed from the wine cellar drawer 1' to be filled with fluid, in particular with water. After filling the humidifier 90 with fluid, the filled humidifier 90 is moved back into the wine cellar drawer 1'. A perspective view of a quite simple exemplary humidifier 90 in form of a tray is illustrated in FIG. 6. However, also other and in particular more complex configurations of the humidifier 90 are possible within the scope of the present invention. The specific shape and design of the humidifier 90 is thus not important and can be adapted to the specific need and design of the wine cellar drawer 1'.

It is further pointed to the fact that the above description was given to show an implementation. However, the scope of protection is defined by the enclosed set of claims and should be not limited by the above described exemplary embodiment.

Finally, it is highlighted that the present disclosure refers not only to wine cellar drawers per se but also to wine cabinets comprising or being formed of several of said wine cellar drawers and kitchen cabinets comprising at least one such wine cellar drawer besides at least one typical built-in like an oven, a refrigerator, a freezer, a micro wave, a coffee machine, a vacuum sealer, a common simple compartment or a common simple drawer for such a cabinet.

REFERENCE NUMERALS

1 wine cellar drawer
10 drawer assembly
10' drawer assembly
12*a* upper cabinet wall

12*b* lower cabinet wall
12*c* right-side cabinet wall
12*d* left-side cabinet wall
14*a* first push-to-open component
14*b* second push-to-open component
16 illumination bar
18 mounting brackets
20 drawer housing
20' drawer housing
20*a* top housing wall
20*b* back housing wall
20*b*1 first section
20*b*2 second section
20*b*3 third section
20*c* front frame
30 drawer
30' drawer
30*a* front panel
30*a*' front panel
32 positioning means
32*a* upper rear sliding stopper
32*b* upper front sliding stopper
32*c* lower sliding stopper
40 cooling unit
40' cooling unit
42 compressor
44 condenser
46 evaporator
48 condenser fan unit
48*a* air inlet
48*b* air outlet
50 evaporator fan unit
50*a* evaporator fan unit housing
50*a*1 first cavity
50*a*2 second cavity
50*b* inlet opening
50*c* outlet opening
60 control unit
70 user interface
74 control panel
74*a* input section
74*a*1 power button
74*a*2 target temperature adjustment button
74*b* display section
80 handle
90 humidifier
B beverage bottle
B1 top end of bottle
D1 sliding direction
D2 direction perpendicular with respect to the sliding direction D1
D3 direction perpendicular to the horizontal plane of the wine cellar drawer 1

The invention claimed is:

1. A wine cellar drawer for storing, displaying and cooling bottles, comprising:

a drawer assembly having a drawer housing configured to be mounted in a cavity of a cabinet and a drawer provided in the drawer housing, wherein the drawer is coupled to the drawer housing to be movable with respect to the drawer housing between an extended position, in which the drawer at least partly protrudes out from the drawer housing, and a retracted position, in which the drawer is positioned within the drawer housing;

a cooling unit defining a refrigerant circuit and comprising a plurality of components of at least a compressor, a condenser and an evaporator, wherein the cooling unit is configured to cool a storage area within the inner of the drawer housing and of the drawer; and a control unit configured to control the operation of the cooling unit;

the plurality of components of the cooling unit are provided at the back of the drawer housing, wherein the condenser is provided outside the drawer housing and behind the drawer housing with respect to a sliding direction of the drawer and rearward of the storage area, wherein said condenser has pipe loops that are stacked vertically and said condenser has an S-shape;

wherein the evaporator is provided within the back of the drawer housing rearward of the storage area, and wherein the condenser and the evaporator are positioned side by side along a direction perpendicular to the sliding direction of the drawer within a horizontal extension plane of the wine cellar drawer.

2. The wine cellar drawer of claim 1, wherein all components of the cooling unit are provided substantially side by side along the direction perpendicular to the sliding direction of the drawer within the horizontal extension plane of the wine cellar drawer.

3. The wine cellar drawer of claim 1, wherein the cooling unit further comprises a condenser fan unit with an air inlet and an air outlet, the condenser fan unit directing in said direction perpendicular to the sliding direction of the drawer within the horizontal extension plane of the wine cellar drawer, wherein in particular both of the air inlet and the air outlet of the condenser fan unit are covered by the condenser.

4. The wine cellar drawer of claim 1, wherein the condenser is formed in the S-shape seen along a direction perpendicular with respect to the horizontal extension plane of the wine cellar drawer.

5. The wine cellar drawer of claim 4, wherein at least one component of the cooling unit is positioned within the S-shaped condenser seen along the direction perpendicular with respect to the horizontal extension plane of the wine cellar drawer.

6. The wine cellar drawer of claim 1, wherein the pipe loops being stacked in the direction perpendicular with respect to the horizontal extension plane of the wine cellar drawer, wherein the stacked pipe loops are formed in a S-shape seen along the direction perpendicular with respect to the horizontal extension plane of the wine cellar drawer.

7. The wine cellar drawer of claim 6, wherein at least one component of the cooling unit is positioned within the S-shaped pipe loops of the condenser seen along the direction perpendicular with respect to the horizontal extension plane of the wine cellar drawer.

8. The wine cellar drawer of claim 1, wherein the cooling unit comprises an evaporator fan unit directing in the sliding direction of the drawer, wherein in particular the evaporator fan unit is provided in the back of the drawer housing at the evaporator.

9. The wine cellar drawer of claim 8, wherein the evaporator fan unit has a evaporator fan unit housing defining at least one cavity, the cavity being formed and positioned such that in the retracted position of the drawer a top end of at least one bottle stored within the drawer can protrude at least partly into said cavity.

10. The wine cellar drawer of claim 1, wherein the wine cellar drawer comprises no separate vent channel to the front side of the wine cellar drawer for the cooling unit.

11. The wine cellar drawer of claim 1, wherein the drawer comprises positioning means, the positioning means having sliding stoppers, the positioning means being configured to hold bottles of various sizes and shapes in position within the drawer.

12. The wine cellar drawer of claim 1, wherein the wine cellar drawer is configured such that bottles having a diameter of up to 96 mm can be stored therein.

13. The wine cellar drawer of claim 1, wherein the wine cellar drawer is of compact size providing an overall height of about 14 cm.

14. The wine cellar drawer of claim 1, wherein the drawer housing comprises at least one insulation layer configured to isolate the inner of the wine cellar drawer thermally from the environment of the wine cellar drawer, wherein the at least one insulation layer is formed at least partially, of heat resistant material.

15. The wine cellar drawer of claim 1, wherein the drawer housing is provided with an upper insulation layer and/or a lower insulation layer each having a height of about 15 mm to 22 mm.

16. The wine cellar drawer of claim 1, wherein the drawer housing has at least one insulation layer comprising at least one, vacuum insulated panel.

17. The wine cellar drawer of claim 16, wherein the vacuum insulated panel are arranged asymmetrically on the upper side and on the lower side of the wine cellar drawer with respect to the horizontal extension plane of the wine cellar drawer to define an asymmetrical insulation.

18. The wine cellar drawer of claim 1, wherein the wine cellar drawer comprises a user interface coupled to the control unit, wherein the user interface is arranged and configured to display relevant operation parameters and/or state information of the wine cellar drawer to a user and/or to receive and to forward operation commands input by the user to the control unit.

19. The wine cellar drawer of claim 18, wherein the wine cellar drawer comprises at least one temperature sensor coupled to the control unit and configured to measure a temperature within the drawer housing and the drawer, wherein the user interface comprises a display configured to indicate the current temperature value measured by said at least one temperature sensor.

20. The wine cellar drawer claim 18, wherein the user interface comprises at least one control panel having at least one input section, having buttons and/or a touch-screen, configured to receive an input of operation commands by the user and to forward the operation commands to the control unit, wherein said at least one input section comprises a power button for switching on and off the cooling unit, and at least one target temperature adjustment button for adjusting the at least one target temperature within the drawer housing and the drawer, wherein said at least one control panel comprises a display section indicating the currently set target temperature.

21. The wine cellar drawer of claim 1, wherein the wine cellar drawer comprises at least one sensor for obtaining information about the current state of the wine cellar drawer, wherein the at least one sensor is coupled to the control unit, wherein the control unit is configured to receive and to process information from said at least one sensor and to set operation parameters for the cooling unit based on the information, wherein in particular one of said at least one sensor is a temperature sensor configured to measure a temperature of any component of the cooling unit, the temperature within the drawer housing and the drawer of the wine cellar drawer or the temperature in the vicinity of the wine cellar drawer.

22. The wine cellar drawer of claim 1, wherein the wine cellar drawer comprises a motion sensor coupled to the control unit and configured to sense whether there is a person and/or any movement within the vicinity of the wine cellar drawer, and the control unit is configured such that it prevents fan units and/or the compressor from starting when someone is in the vicinity of the wine cellar drawer.

23. The wine cellar drawer of claim 1, further comprising:

a wine cabinet having said wine cellar drawer, wherein the wine cabinet comprises several of said wine cellar drawers combined with each other to form said wine cabinet.

24. The wine cellar drawer of claim 1, further comprising:

a kitchen cabinet comprising:

at least one typical built-in having a compartment or a drawer, and said wine cellar drawer.

* * * * *